US006176307B1

(12) United States Patent
Danos et al.

(10) Patent No.: US 6,176,307 B1
(45) Date of Patent: Jan. 23, 2001

(54) TUBING-CONVEYED GRAVEL PACKING TOOL AND METHOD

(75) Inventors: Joe C. Danos; Arlen R. Schmalz, both of Lafayette, LA (US)

(73) Assignee: Union Oil Company of California, El Segundo, CA (US)

( * ) Notice: Under 35 U.S.C. 154(b), the term of this patent shall be extended for 0 days.

(21) Appl. No.: 09/246,436

(22) Filed: Feb. 8, 1999

(51) Int. Cl.[7] ..... E21B 43/04
(52) U.S. Cl. ..... 166/51; 166/276; 166/278
(58) Field of Search ..... 166/51, 276, 278

(56) References Cited

U.S. PATENT DOCUMENTS

| | | | | |
|---|---|---|---|---|
| 3,051,243 | | 8/1962 | Grimmer et al. | 166/332.7 |
| 3,398,795 | | 8/1968 | Elliston | 166/120 |
| 3,726,343 | | 4/1973 | Davis, Jr. | 166/278 |
| 3,913,675 | | 10/1975 | Smyrl | 166/278 |
| 4,105,069 | | 8/1978 | Baker | 166/51 |
| 4,253,522 | | 3/1981 | Setterberg, Jr. | 166/278 |
| 4,428,428 | * | 1/1984 | Smyrl et al. | 166/278 |
| 4,685,519 | | 8/1987 | Stowe et al. | 166/278 |
| 4,793,411 | * | 12/1988 | Zunkel | 166/98 |
| 4,842,057 | * | 6/1989 | Lubitz | 166/51 |
| 4,951,750 | * | 8/1990 | Wetzel, Jr. | 166/278 |
| 5,062,484 | | 11/1991 | Schroeder, Jr. et al. | 166/278 |
| 5,174,379 | | 12/1992 | Whiteley et al. | 166/278 |
| 5,332,038 | | 7/1994 | Tapp et al. | 166/278 |
| 5,373,899 | * | 12/1994 | Dore et al. | 166/278 |
| 5,597,040 | * | 1/1997 | Stout et al. | 166/51 |
| 5,722,490 | | 3/1998 | Ebinger | 166/281 |

* cited by examiner

*Primary Examiner*—David Bagnell
*Assistant Examiner*—Jennifer R Dougherty
(74) *Attorney, Agent, or Firm*—William O. Jacobson; Gregory F. Wirzbicki

(57) ABSTRACT

After installing an inventive tool attached to production tubing in a well, the well can be gravel packed without the use of a well intervention unit. The tool isolates a productive interval and diverts tubing-conveyed sand slurry towards an annular location by means of a port and an openable passageway restrictor. The entraining fluid component of the diverted sand slurry in the annular location is allowed to re-enter the production tubing through a first screen while the separated sand drops to the annular location to be packed in an axial direction. Rupture of a plug then allows the separated sand to be packed in an axial direction.

35 Claims, 5 Drawing Sheets

TUBING-CONVEYED GRAVEL PACKING TOOL AND METHOD

FIELD OF THE INVENTION

This invention relates to underground well completion devices and processes. More specifically, the invention is concerned with an improved tool and method for gravel packing an underground well.

BACKGROUND OF THE INVENTION

When drilling and completing a well in an underground formation, a fluid or fluid-like substance having a density greater than water is typically used, e.g., a heavy weight drilling mud and water mixture. The dense mixture produces overbalanced hydrostatic pressures (i.e., pressures in excess of the formation pore pressures) in the well, e.g., to help prevent wellbore wall caving, to consolidate loose formations, or to control well pressure by minimizing the risk of excessive gas from the formation entering the wellbore.

However, the dense mixture tends to intrude into permeable portions of the formation, such as a productive interval. This intrusion can damage the productive interval, e.g., penetration of a water-based drilling fluid into a clay-containing formation can cause swelling and a loss of permeability. Damage to a productive interval may only be shallow (e.g., "skin" damage) and relatively easy to correct, but the damage may also be more extensive and permanent.

In a conventional well completion that includes a gravel pack (e.g., for sand control of a productive formation), a viscous as well as dense fluid (such as brine) may be used to entrain gravel particles and carry the stabilizing particles as a slurry into the face of the sandy formation to form the gravel pack. But the entraining fluid may cause further damage to the formation. Fluid loss control measures may also be required during a conventional gravel packing process, e.g., adding LCM "pills" or other fluid additives to control lost circulation when using a work string and backflushing tools to remove excess sand or gravel slurry. Coiled tubing and associated tools may also have to be run and nitrogen injected through the coiled tubing to bring a conventionally gravel packed well into production, adding still more risk of formation or other damage.

Significant costs are typically required for a drilling rig or other well intervention unit to be on-site during a conventional gravel packing process. The rig is typically used periodically throughout the conventional gravel packing process, e.g., to place, support, reposition, activate, and/or remove gravel packing tools downhole. The rig may be required to be on-site for many days during a conventional gravel packing process.

Use of a rig allows one or more packers attached to a work string to isolate a productive interval or zone during gravel packing. The isolated zone and work string allow a pressurized, but less dense fluid to be used to entrain the sand or gravel without exposing other portions of the wellbore to the pressurized fluid. But backflushing steps and means for removing excess slurry are typically required when a packer is used. In addition, placing, backflushing, and removing packers and other tools add costly rig time and entail other damage risks.

SUMMARY OF THE INVENTION

Such added rig costs and damage risks of gravel packing a productive wellbore interval are minimized by using a gravel packing assembly attached to a production tubing string that can be used without a rig after it is placed in a well. One embodiment of the inventive assembly uses an upper axial-flow plug to divert a pumped-down slurry from the interior of the production tubing to an annulus through a radial-flow port located above the upper axial-flow plug, and allow some of the entraining fluid portion of the slurry in the annulus to enter an interior passage through a first radial-flow screen located below the upper axial-flow plug. Initially, a lower axial-flow plug located below the first radial-flow screen prevents the flow of screen-separated entrainment fluid through the interior passage to a second radial-flow screen located below the second plug proximate to a productive interval. But when slurry continues to be pumped downhole and sufficient slurry particles are de-entrained in the annulus proximate to the productive interval, the resulting axial differential pressure across the de-entrained particles is transmitted through the screens and ruptures the lower plug, allowing screen-separated entrainment fluid to flow out of the second radial-flow screen and excess slurry to be displaced by a displacement fluid before the first plug is ruptured and formation fluids produced.

In addition to avoiding the need for a rig after emplacing the apparatus, the inventive process also avoids the need for a work string. Still further, the inventive process clears the production tubing of excess or residual sand slurry without the need for complex process steps to backflush or reverse the pumped slurry flow.

BRIEF DESCRIPTION OF THE DRAWINGS

In these Figures, it is to be understood that like reference numerals refer to like elements or features.

DETAILED DESCRIPTION OF THE INVENTION

Figure 1:
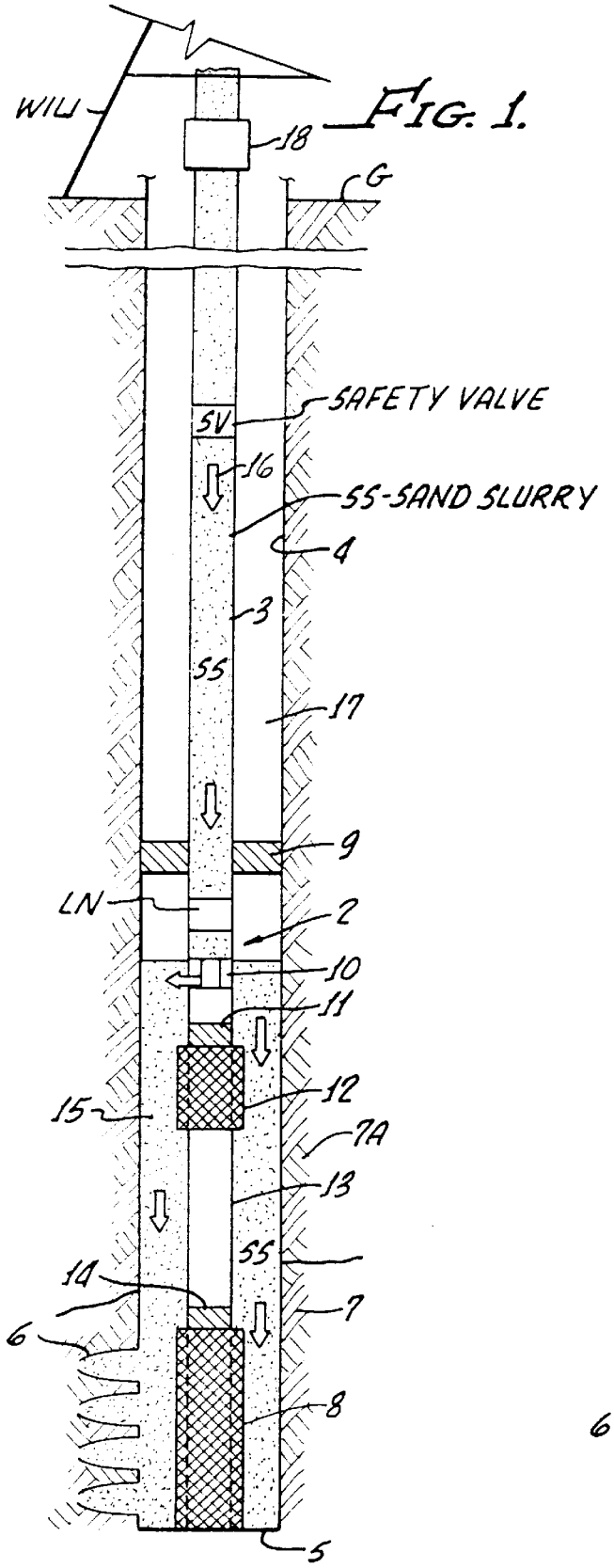
FIG. 1 shows a schematic cross-sectional view of a well after an inventive gravel pack assembly attached to a production tubing string is run into the well.

FIG. 1 shows a schematic view of a preferred embodiment of an inventive gravel pack apparatus or assembly 2 attached to a production tubing string 3 that was previously run into a cased wellbore 4. The cased wellbore 4 extends from near a surface G to a well bottom 5. Near the well bottom 5 in the wellbore 4, perforations 6 extend into a subsurface formation of interest or a producing zone 7. Although the cased wellbore 4 is shown in FIG. 1 as a nearly vertical wellbore having a constant diameter, alternative embodiments of the inventive assembly can be placed in deviated wellbores, wells having progressively smaller diameter casings or a liner, wells having an open wellbore at the producing zone 7, and many other types of underground wells or excavations.

The perforations 6 are shown in FIG. 1 as circular holes in the cased wellbore 4 and generally coned-shaped spaces extending into the formation of interest 7, but perforations in other applications may have other shapes, for example, helically-shaped openings. The perforations 6 can be produced downhole by shaped explosive charges, but may be installed as a slotted or perforated liner, undercut, or produced by other methods known to those skilled in the art.

The perforations 6 are only one of many types of well and/or well completion applications that can use the inventive apparatus 2. Besides perforated wells, other applications that may benefit from the use of the inventive gravel-packing apparatus include open hole completions, pumped wells, injection wells, horizontal wells, frac pack completions, acid stimulated completions, and water packed completions.

The production tubing or duct string 3 has an axial-flow fluid passageway that extends from near surface G to near the bottom 5 of wellbore 4. The production tubing string 3 preferably comprises joined tubing sections, but the production tubing string may also comprise joined pipe or conductor sections, coiled tubing, or other duct-like elements known to those skilled in the art. The joined tubing sections can be directly attached to each other by welding, mating threads at each end or other means for joining known to those skilled in the art. The tubing sections may also be joined to form production tubing 3 using end fittings, couplings, or other indirect connectors known to those skilled in the art.

Because the production tubing string 3 in the inventive process handles a sand slurry SS, tubing sections and connectors should be erosion resistant. This can include selecting tubing sections composed of hardened materials, avoiding sharp corners or bends, using gap fillers at connectors, and selecting tubular diameters and fluid handling components to avoid excessive slurry velocities. Depending upon the production fluids that the production tubing string 3 must also handle, the tubing string may also have to be corrosion resistant and allow reservoir fluids to flow to the surface without excessive pressure loss or slippage.

In addition to carrying produced formation fluids to the surface, the production tubing string 3 differs from a work string in other respects. A typical work string has a diameter that is no larger than about 3½ inches whereas a typical production tubing string has a larger diameter, e.g., a diameter of up to about 4½ inches. Using a production tubing string allows larger diameter remedial tools to be used and reduces erosive flow velocities. A pressure rating of a work string can be up to about 30,000 psi or higher, but a production tubing string pressure rating typically ranges from about 5,000 to about 20,000 psi. A higher pressure rating may be required for a production tubing string used with the inventive apparatus.

Although the production tubing string 3 shown in FIG. 1 extends from surface G through non-producing formation 7A to near a formation of interest 7 located proximate to the well bottom 5, the formation of interest can also be located significantly above the well bottom in other applications. Where the formation of interest 7 is located significantly above the well bottom 5, an alternative embodiment of the inventive assembly includes a second or bottom packer (similar to packer 9) attached to the tubing string 3 below the gravel pack screen 8. The two packers in the alternative embodiment isolate the portion of cased wellbore 4 proximate to the formation of interest 7 from the rest of the wellbore, e.g., different fluids may be introduced into the isolated annular space 15 separate from fluids in the upper annular space 17 above or any annular space below the bottom packer.

The gravel packing assembly 2 also includes an optional surface control subsurface valve ("SV"), an optional landing nipple ("LN"), a sliding sleeve or port 10, a glass disk or first passageway restrictor 11, a tell-tale screen or first filtering element 12, a blank length of pipe or blank tubing section 13, a pump-out plug or second passageway restrictor 14, and a gravel pack screen or second filtering element 8.

Figure 4:
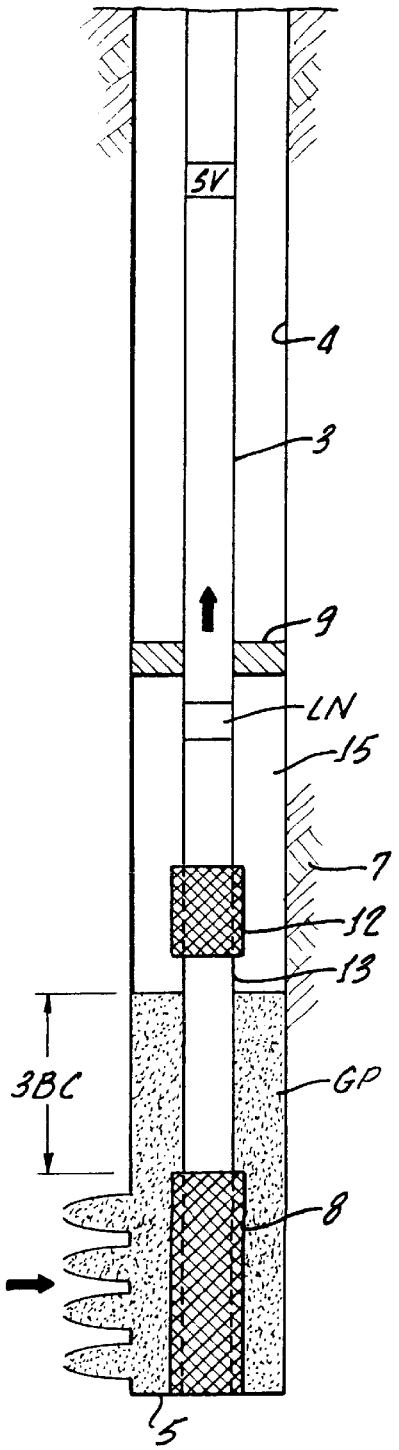
FIG. 4 shows the assembly shown in FIG. 1 during the production of formation fluids after rupture of a glass disk.

Open arrows 16 in FIG. 1 depict the flow of sand slurry SS (shown as a dotted media) comprising an entraining fluid and sand or gravel particles. The sand slurry SS is pumped by pump 18 (typically located at or near surface "GI") down the production tubing string 3 and diverted by disk 11 through the sliding sleeve 10 into the isolated annular space 15. Once in the isolated annular space 15, the sand slurry SS generally flows down toward the perforations 6 and in the formation of interest 7. Although the formation of interest 7 is typically porous, the interstitial openings of the formation tend to de-entrain particles by preventing the particle component of the sand slurry SS from entering into the formation, but the porous nature and interstitial openings allow entry of the entraining fluid component. The flow of entraining fluid component into the formation 7 tends to pack the de-entrained particles against the face of the formation and/or perforations, eventually forming the desired gravel pack as shown in FIG. 4.

The pump 18 shown in FIG. 1 is preferably a positive displacement slurry pump, such as a 680 HHP pumping unit manufactured by Haliburton Energy Services, located in Duncan Okla. The preferred pump 18, including pressure and flow controls, is capable of surface pressures and flows of up to about 9,000 psig and 560 gpm. Alternatively, other types of pumps or means for pressurizing a fluid or fluid-like substance may be used, such as a reciprocating pump, an injector or lobed pump, a centrifugal pump, and a sludge or screw pump. Alternative pumps should be capable of pumping a slurry at flows and pressures of at least about 40 gpm and 1,000 psig, preferably at least about 250 gpm and 5,000 psig or otherwise sufficient to pack de-entrained particles while injecting the entraining fluid component of a slurry into the formation of interest 7.

The optional safety valve SV controls pressure in tubing above the valve if an unexpected failure or other unwanted event occurs, e.g., intrusion of an unwanted fluid into the tubing. The optional safety valve SV is typically used for offshore applications, but may not be required for other applications. A representative subsurface safety valve SV for pressure control is a model TRM-4 that may be obtained from the CAMCO Products & Services Company located in Houston, Tex.

After being set, the packer 9 restricts the flow of fluid or sand slurry between the isolated annular space 15 and the upper annular space 17. A preferred packer 9 is a hydraulic-set Model RH packer that may be obtained from Halliburton Energy Services Company located in Duncan, Okla. Preferably, packer 9 should allow fluid pressures in the isolated annular space 15 to range up to about 10,000 psig and fluid temperatures of up to about 350° F., but lower pressure and temperature capabilities can also be acceptable for some applications.

The landing nipple LN shown in FIG. 1 is used to actuate the isolation packer 9. After actuating the packer 9, the assembly is typically pressure tested to verify that the pressure integrity allows isolation of the portion of the annulus to be gravel packed and future uphole use once the gravel packing is completed. A representative landing nipple LN is a model XN that may be obtained from the Halliburton Energy Services Company located in Duncan, Okla. Alternatively, setting or actuation of the packer 9 may also be accomplished by hydraulic or pneumatic fluids contained within small diameter actuation tubing (not shown) run into the well, electrical signals transmitted through wires (not shown) within the well, rotation of the production tubing string 3, or a slickline (not shown). Alternative packers or other means for restricting axial flow between annular spaces 15 and 17 can include other mechanically actuated packers or annular plugs, gravel packers, inflatable devices, and other means for restricting annular flow known to those skilled in the art.

When in the open position, the optional sliding sleeve or ported sub 10 provides a sealable port or restrictable path for sand slurry SS or other fluid-like substances flowing down production tubing string 3 to be diverted radially outward into the isolated annular space 15, typically at a location significantly above the formation of interest 7. Although initially open, when the sliding sleeve 10 is in the restricted or closed position, fluid communication between the isolated annular space 15 and the interior of production tubing string 3 at this location is restricted or prevented. A representative sliding sleeve 10 is a model CMD that may be obtained from the Baker Oil Tools Company located in Houston, Tex. In an alternative embodiment, other means for controllably restricting flow to or from the tubing string 3 at this location can be used instead of the sliding sleeve 10, including a valved port, a variable orifice restrictor, a pressure/flow actuated check or flapper valve, and other flow control means known to those skilled in the art.

In another alternative embodiment of the inventive assembly, a fixed flow restrictor is used in place of the sliding sleeve 10, e.g., a radial-flow port or fixed orifice. Although the alternative radial-flow port or orifice may be plugged or covered during installation of the assembly 2 in the wellbore 4, once the alternative radial-flow port is open and the packer 9 is set, the alternative radial-flow port allows substantial fluid communication between the isolated annular space 15 and the interior of tubing string 3. But because the gravel pack GP is later formed between the formation of interest 7 and the alternative radial-flow port or orifice, fluid flow is inherently more restricted after the gravel pack is in place.

The disk or first passageway restrictor 11 initially restricts sand slurry SS (or other fluid-like materials) from flowing within the interior passageway of production tubing string 3 downwards towards the upper or tell-tale screen 12. After the first and second passageway restrictors 11 & 14 are partially or fully opened, downward flow within the tubing string 3 from above is allowed as well as upward flow through the screens 12 & 8 and blank tubing string portion 13 into the tubing string 3. A representative first passageway restrictor 11 is a frangible glass disk that may be obtained from the Halliburton Energy Services Company located in Duncan, Okla. Opening of the glass disk 11 or other first means for restricting axial flow within the production tubing string 3 is preferably accomplished by impact. Alternatively, other first means for restricting passageway flow and other means for opening may be employed, e.g., pressure rupturing a scored disk, impact or pressure shearing a shear-pin holding a restrictor, dissolving a plug or retainer in acid or other fluids, drilling out a drillable disk, actuating a controllable restrictor using an electrical or other signaling/actuating means, weakening a rupture disk by heating or contact with high temperature fluids prior to pressure or impact rupturing, and other means for opening an openable restrictor known to those skilled in the art.

The tell-tale screen or first means for screening 12 allows fluid communication between the isolated annular space 15 and the fluid passageway of the production tubing string 3 and blank tubing portion 13 while restricting the flow of some fluid-entrained sand and/or other particles. Expressed in other terms, the tell-tale screen 12 pre-screens the sand slurry SS from the isolated annular space 15 allowing the entraining fluid portion of the slurry to flow through the gravel pack screen 8 during the process of producing the gravel pack GP. A representative tell-tale screen 12 allows radial fluid flow through a circumferential stainless steel, wire wrap screen with 0.006 gauge slots over circumferential perforations in a base tubing element having a diameter ranging from about ¼ to ½ inch. The tell-tale screen 12 may range from about one to five inches in diameter and from about 2 to 30 feet long. A preferred tell-tale screen 12 may be obtained from the Baker Oil Tools Company located in Houston, Tex., but many different screen suppliers, mesh sizes, and dimensions can be used as appropriate for the application. Alternative first means for screening particles can include a screened port, a slotted tubular or liner, a pre-packed section, a wound pipe section, a cyclone separator, a filter, a magnetic or electrostatic particle remover, a duct made from porous materials, and other means for screening particles from a slurry flow that are known to those skilled in the art.

The optional blank duct or tubing portion 13 on assembly 2 provides a fluid conduit or path through the later-accumulated sand or gravel GP (see FIGS. 2–4) between the upper or tell-tale screen 12 and the lower or gravel pack screen 8. Although the length of the blank duct or tubing portion 13 may vary widely, the length should be sufficient to allow a significant deposit of de-entrained gravel or sand, preferably at least about 2 feet long, more preferably at least about 10 feet long, and most preferably a tubing section at least about 30 feet long. Although the diameter of the blank duct or tubing portion 13 may vary widely, a diameter sufficient to allow fluid flow without substantial pressure loss while also creating an annular space 15 large enough to accommodate the desired amount of gravel pack GP is preferred, e.g., tubing portion 13 having a diameter preferably ranging from about 20% to about 80% of the wellbore diameter, more preferably from about 40% to about 60% of the wellbore diameter.

As shown in FIG. 1, the pump-out plug 14 is emplaced within the blank tubing portion 13. This may take the form of a pump-out plug 14 being placed between two tubing sections that form the blank tubing portion 13. The pump-out plug 14 restricts axial fluid flow in the blank tubing portion 13. Although axial flow within the blank tubing portion 13 is restricted, a pressure differential across the pump-out plug 14 is created by fluid communication through the two screens 8 & 12 allowing filtered fluid into the interior passageway of the blank tubing portion 13 from the isolated annular space 15. The frictional pressure losses of the flow 16 of sand slurry SS or other fluid axially flowing across the later accumulated sand or gravel GP in the isolated annular space is therefore communicated as a differential pressure across the pump-out plug 14 within the blank tubing portion 13. Alternatives to the blank tubing portion 13 can include a holder for the pump-out plug 14 set between screens 8 and 14, full or partially-enclosed duct portions having various cross-sectional geometries, multi-flow path elements, and other known means for achieving a restrictable flow path subject to differential pressure.

After the restriction caused by the optional pump-out plug or second means for restricting passageway flow 14 is ruptured, removed, or otherwise opened, the entraining fluid portion of the sand slurry SS in the isolated annulus 15 is allowed to flow through the tell tale screen 12 and through the blank tubing portion 13 towards the gravel pack screen 8. Opening the pump-out plug or second passageway restrictor 14 also later allows formation fluid to flow towards the surface G after plug 10 is opened. A representative pressure rupturable or pump-out plug 14 is a pump-out plug sub with a solid insert that may be obtained from the Halliburton Energy Service Company located in Duncan, Okla. Alternative means to shear, rupture, remove or otherwise open the second passageway restrictor 14 are generally similar to the alternative means for opening the first passageway restrictor 11 described above, but the alternative means to open the second passageway restrictor should avoid also opening the first passageway restrictor prior to opening the second passageway restrictor.

In an alternative embodiment of the inventive assembly, the optional pump-out plug or second passageway restrictor 14 is eliminated. The lack of a second passageway restrictor 14 allows filtered entraining fluid from the sand slurry SS to flow down the passageway within the blank tubing portion 13 towards the gravel pack screen 8 during much of the gravel packing process. The tell-tale screen 12 may have to be increased in size to reduce fluid and particle velocities at the screen, allowing the lower velocity screened particles in the isolated annular space 15 to drop towards the perforations 6. Although eliminating the second passageway restrictor 14 simplifies the tool, the absence of the second passageway restrictor may not allow a sufficient axial-flow pressure drop across the de-entrained particles to fully pack the particles and obtain the desired properties of the gravel pack.

The gravel pack screen or second means for screening 8 allows fluid communication from the annular space 15 into the passageway of the tubing portion 13 toward the tubing string 3 while restricting or filtering the movement of some sand or gravel particles into the passageway. A preferred gravel pack screen 8 is composed of inner and outer stainless steel welded wire wrap screens with 0.006 gauge slots covering a filled space containing bonded 40/60 mesh sand over circumferential perforations in a base tubing having a diameter ranging from about ¼ to ½ inch and may be obtained from the Baker Oil Tools Company located in Houston, Tex. Alternative second means for screening are similar to the alternative first means for screening described above. In still another alternative embodiment, the gravel pack and tell tale screens are combined into a single means for screening extending over a significant length of the wellbore, allowing the gravel pack to accumulate around only a portion of the means for screening rather than the preferred gravel pack screen 8 and tubing portion 13 leaving the tell-tale screen 12 spaced apart from the gravel pack GP.

The process steps of using the inventive assembly 2 are illustrated in the sequence of apparatus and fluid flow conditions shown in FIGS. 1 through 4. FIG. 1 shows the inventive assembly 2 after the assembly is attached to a portion of a tubing string 3 and run into the cased wellbore 4 using a well intervention unit WIU, such as a drilling rig, a workover rig, or a snubbing unit. After the packer 9 is set in the wellbore 4 and a wellhead piping "tree" and pump 18 connected to the tubing string 3 at or near the surface G, the WIU can be removed. The conventional processes of using a well intervention unit to run a tubing or pipe string into a well with an attached assembly or tool including one or more packers, set a packer, connect a piping tree and pump, and move the well intervention unit off-site are known to those skilled in the art.

FIG. 1 shows a pressurized sand slurry SS (shown as a dotted media comprising sand or gravel particles and an entraining fluid) initially being pumped by the surface pump and piping 18 through production tubing string 3 towards the formation of interest 7. The sand slurry SS flowing down the production tubing string 3 is diverted by disk 11 through the open sliding sleeve 10 into the isolated annular space 15 between portions of the assembly 2 (including the tubing portion 13) and the cased wellbore 4. The diverted sand slurry SS in the isolated annulus 15 tends to flow towards the perforations 6 and the formation of interest 7.

Figure 2:
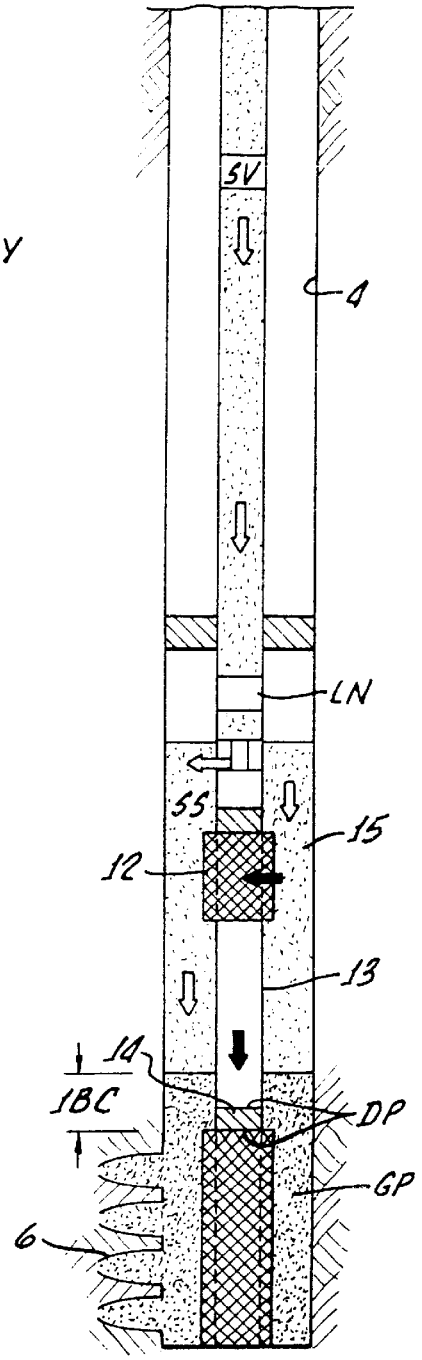
FIG. 2 shows the assembly shown in FIG. 1 after pumping a slurry when a resulting gravel pack is beginning to accumulate in an isolated annulus portion of the well.

FIG. 2 shows the resulting initial build-up of de-entrained sand or gravel particles GP (shown as a closely spaced dotted media) in the isolated annular space 15 after pumping a portion of the sand slurry SS towards the perforations 6. The initial build-up of the de-entrained sand or gravel particles GP begins to cover the exterior of the blank tubing portion 13 and fill the perforations 6. The pumped flow of sand slurry SS across this initial build-up of particles GP (depositing a significant portion of the sand or gravel particle component while the entraining fluid component flows into the formation 7) creates an axial pressure drop across the length of the particle build-up GP. The axial pressure drop is communicated to the interior of blank tubing portion 13 as a differential pressure DP across the pump-out plug 14. The pump-out plug 14 is set to shear out when the gravel pack GP covers the blank portion 13 to approximately a desired axial or rupture length and the axial-flow across this desired length of obstructing particles creates a sufficient pressure drop and communicated differential pressure DP to rupture the pump-out plug. However, the initial partial length 1BC of the particles covering the blank tubing portion 13 at this stage in the process is not sufficient to result in a differential pressure DP that ruptures or shears out the pump-out plug 14.

The diagonally-dashed arrows shown in FIG. 2 depict the flow of the entraining fluid portion of the sand slurry SS after passing through the tell-tale screen 12, i.e., the fluid flow direction is depicted after the entraining fluid portion of the sand slurry is filtered from the sand or gravel portion by the tell-tale screen 12. Various fluids may be used as the entraining fluid portion of the sand slurry SS, typically a completion or other fluid compatible with the formation such as a light hydrocarbon fluid, an inert synthetic fluid, or a previously-recovered formation fluid. Some desirable properties of a particle-entraining fluid include a density low enough to accomplish underbalanced operations if required and high enough to maintain reasonable surface pump pressures, a viscosity sufficient to entrain particles, and a low solubility of formation materials. Once the entraining fluid flows into the formation 7, other fluid properties may become important, e.g., a maximum viscosity at reservoir conditions to allow fluid movement without unreasonable pressure losses.

Although the sand slurry SS remains in the production tubing string 3 during the process step illustrated in FIG. 2, the remaining sand slurry does not need to be backflushed out of the production tubing string. The remaining sand slurry SS in the production tubing 3 is displaced and diverted into the isolated annular space 15 where de-entrained particles are deposited on the initial build-up of de-entrained particles. Although not required, reverse flow or flushing the sand slurry SS remaining in tubing 3 may also be accomplished if desired.

Rupture of the pump-out plug 14 typically occurs before any substantial opening or removal of disk 11. The pump-out plug 14 remains in place until the fluid flow across a sufficient length of deposited sand or gravel particles GP creates a communicated differential pressure DP exceeding the rupture strength of the pump-out plug. In the preferred embodiment, a slick-line or other mechanical opening means later opens the disk 11. If a larger gravel pack is needed to control sanding during oil production from the formation of interest 7, the rupture strength and the plug-rupturing length of deposited sand GP (as well as the length of blank tubing portion 13) can be increased in alternative embodiments to provide for more deposited sand or gravel particles GP in the isolated annular space 15. Alternative embodiments of the inventive assembly 2 may include other first means for restricting the passageway from the tubing string 3 instead of the pump-out plug 14, but the means for opening or rupturing the pump-out plug or alternative first restrictor means should be operable without significantly opening or rupturing the disk 11 or alternative second restrictor means.

Figure 3:
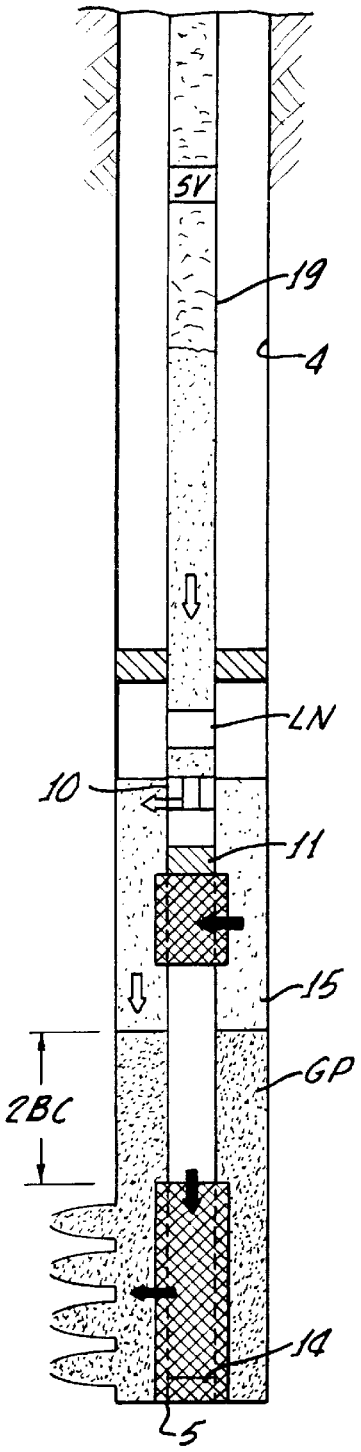
FIG. 3 shows the assembly shown in FIG. 1 after rupture of a pump-out plug when displacing excess sand or gravel slurry in the production tubing.

FIG. 3 shows the inventive packing apparatus after rupture of the pump-out plug 14 (shown resting near the well bottom 5 in FIG. 3 instead of the installed position as shown in FIG. 2) allows the fluid in the blank tubing portion to flow, bypassing much of the gravel pack GP and radial-flow packing the gravel pack GP. FIG. 3 also shows a displacement fluid 19 (shown as a media above the sand slurry SS) displacing excess sand or gravel slurry SS from the production tubing string 3. The displacement fluid 19 is pumped down the production tubing string 3 with the flow direction being depicted as an arrow in the displacement fluid media. The flow of displacement fluid 19 and displaced sand slurry SS (as depicted by open arrows in a dotted media) is diverted by glass disk 11 towards the isolated annular space 15 through the sliding sleeve 10. Some particles in the diverted sand slurry SS within the isolated annular space 15 drop and/or flow towards the previously deposited build-up of sand or gravel particles GP, depositing more particles on the build-up GP. However, some of the displacement fluid as well as the remaining entrainment fluid portion of the slurry (as depicted by solid arrows) flows through the tell-tale screen 12 and the blank tubing section 13 to flow radially outward through the gravel pack screen 8 and across the gravel pack GP into the formation of interest 7. The gravel pack GP creates a resistance to radial flow resulting in a radial pressure drop and tending to further compress the de-entrained particles against the face of the formation of interest 7.

As the remaining sand slurry SS is displaced by the displacement fluid 19 towards the gravel pack build-up GP, more particles are separated at the gravel pack build-up filling any space created by the radial-flow compaction and adding to the length of the blank tubing portion 13 covered by the particles. This increased amount of gravel build-up GP is shown in FIG. 3 as a partial length 2BC that is greater than the initial partial length 1BC shown in FIG. 2.

FIG. 4 shows a cross-sectional schematic view of the completed gravel pack GP when a formation fluid, such as brine, oil, or natural gas, is being produced. The completed gravel pack GP covers much of the blank tubing portion 13 over a completed length 3BC. The completed length 3BC is typically longer than partial lengths 1BC and 2BC as shown in FIGS. 2 and 3.

The flow of produced formation fluid from the formation of interest 7 up towards the surface G through the inventive assembly 2 and production tubing string 3 is represented by solid arrows in FIG. 4. Most of the produced fluid flows radially through the gravel pack GP before entering the gravel pack screen 8 and flowing up through the production tubing string 3. The hydraulic packer 9 continues to restrict formation fluid flow from the isolated annular space 15 towards another annular space in the well 4.

Although the sliding sleeve or restrictable port 10 of the preferred embodiment is typically closed at this point in the process, in an alternative embodiment, the sliding sleeve may be reopened. Although formation fluid can theoretically flow within the isolated annular space 15 to the tell-tale screen 12 and/or to the reopened sliding sleeve, the resistance to axial fluid flow provided by the length 3BC of gravel pack GP tends to limit these flow paths when compared to the relatively less-restricted flow path radially through the gravel pack GP into the interior passageway of the inventive assembly and up the production tubing string 3.

An alternative process of using the inventive apparatus pumps a predetermined amount of sand slurry SS into the production tubing string 3 and uses other means to rupture the pump-out plug 14 rather than having fluid flow over a gravel pack length and the resulting differential pressure cause the rupture of the pump-out plug. After the predetermined amount of sand slurry SS is displaced, a surface fluid pressure increase or other means can be used to rupture the pump-out plug or other second passageway restrictor 14. The predetermined amount of sand slurry SS and/or the controlled shearing out of the pump-out plug 14 provides additional assurance that the gravel pack is sufficient and properly in place prior to the production of a formation fluid.

Another alternative process of using the inventive apparatus is to pump the sand slurry SS with changing or staged concentrations of sand or gravel particles, e.g., pumping slurries having progressively less sand prior to shearing out the pump-out plug 14. This alternative process can reduce the risk of insufficient or excessive amounts of sand slurry SS in the production tubing when screen-out or plug rupture occurs. This alternative method may be especially applicable for deep wells when the volume of sand slurry SS in the production tubing 3 can be large and the volume required to pack the perforations can not be reliably determined before beginning the gravel packing process, making added control over the gravel packing process more desirable.

After the sand slurry SS has been displaced from the production tubing string 3, the pump-out plug 14 is sheared, and the desired gravel pack GP is emplaced, a slickline or other means can be used to shift or close the sliding sleeve 10 and break or open the glass disk 11 without requiring a well intervention unit WIU (see FIG. 1). Once the flow path through the sliding sleeve 10 is closed and the flow path at the glass disk 11 opened, produced formation fluids can flow through the deposited sand or gravel pack GP and into the production tubing string 3 through the gravel pack screen 8. The produced fluids can also flow from the isolated annular space 15 to the production tubing string 3 through the tell-tale screen 12 and up to surface G (see FIG. 1).

An important advantage of the present invention over conventional water pack techniques is the ability to gravel pack formations having high pore pressures with lower weight (and lower cost) completion fluids. Other advantages include eliminating the need for coiled tubing to wash or backflush excess sand and sand slurry, the use of larger or full diameter (production) tubing and gravel pack screen allowing improved access to the completion areas if later remedial operations are required, and allowing unpumped wells to be put into production without the need for coiled tubing or nitrogen.

The inventive gravel packing apparatus and method is anticipated to be especially advantageous for some applications when compared to current methods. For example, in wellbores where casing damage or where squeeze perforations exist above the packer 9, it may not be possible to reverse-flow excess slurry out of the work string. Since a reverse flow step is not needed in the inventive gravel pack process, gravel packing is now feasible in these types of wellbores.

It is also anticipated that the inventive process and assembly 2 will be especially applicable to frac-pack completions. For example, selecting the initial sand slurry pressures and particle sizes used with the inventive assembly 2 could be used to fracture the formation and drive wedging particles into the newly formed fractures while later particle sizes and slurry pressures deposit sand or gravel particles to form a gravel pack in the newly formed fractures and the isolated annular space 15. The process of selecting pressures and particle sizes when combined with the flow paths and isolated annular space 15 formed by the inventive apparatus 2 allows improved control of both the fracturing and packing steps while avoiding the need for a well intervention unit.

It is also anticipated that the preferred embodiment of the inventive gravel pack apparatus and process will not be the optimum choice for some applications or that modifications to the preferred embodiment may be desirable for other applications. For example, guide vanes or other modifications to the preferred embodiment of the inventive apparatus may be required for highly deviated or horizontal well applications to avoid excessive deposits of particles on the lower side of the wellbore 4. Other applications that may be unsuitable or require modifications to the preferred embodiment include wells with a long perforated interval length, slim holes, wells having surface pressure limitations, wells having tubulars that are easily eroded by sand or gravel slurry flow, wells with widely varying production tubing diameters that might tend to prematurely separate sand or gravel from a slurry flow, and the presence of some types of wellbore apparatus (e.g., plug-back packers) that may allow early de-entrainment of particles or impede the application of the inventive apparatus and process in the wellbore 4. Even if the gravel packing application does not require modification to the apparatus as shown, designing the inventive apparatus to avoid significant early de-entrainment or loss of sand or gravel may be desirable.

Two important design considerations for the inventive gravel packing apparatus and process involve selecting a surface treating or pump pressure and selecting a size for the blank tubing portion 13 within wellbore 4, the tubing portion size defining the size of the isolated annular space 15. The pump pressures and tubing sizes should be selected to minimize the risk of depositing sand at locations other than near the perforations 6.

The maximum surface pressure typically occurs during the initial screenout event while doing the displacement step of the inventive gravel packing process as shown in FIG. 2, but the maximum surface pressure can occur at any number of points in the process. Variations in the maximum surface pressure can be caused by rupture or shear strength variations in plug 14 or disk 11, shear pin or disk size deviations, sand compaction variations, gravel compaction variations, pump performance changes, and the inherent variations in fracture characteristics and fluid transmissibility of the formation 7. The following four equations predict a nominal maximum surface pressure for these conditions:

$$dPf = \frac{2f(MD)(Vel)^2(RHO)}{32.17\ d/144} \tag{1}$$

$$Pwfi = Ps + \frac{(BPM)1440}{Ji} \tag{2}$$

$$WHP = Pwfi - 0.052(TVD)(PPG) + dPf \tag{3}$$

(prior to screen out)
or $$WHP = Pwfi - 0.052(TVD)(PPG) + dPf + Pdp \tag{4}$$

Figure 5A:
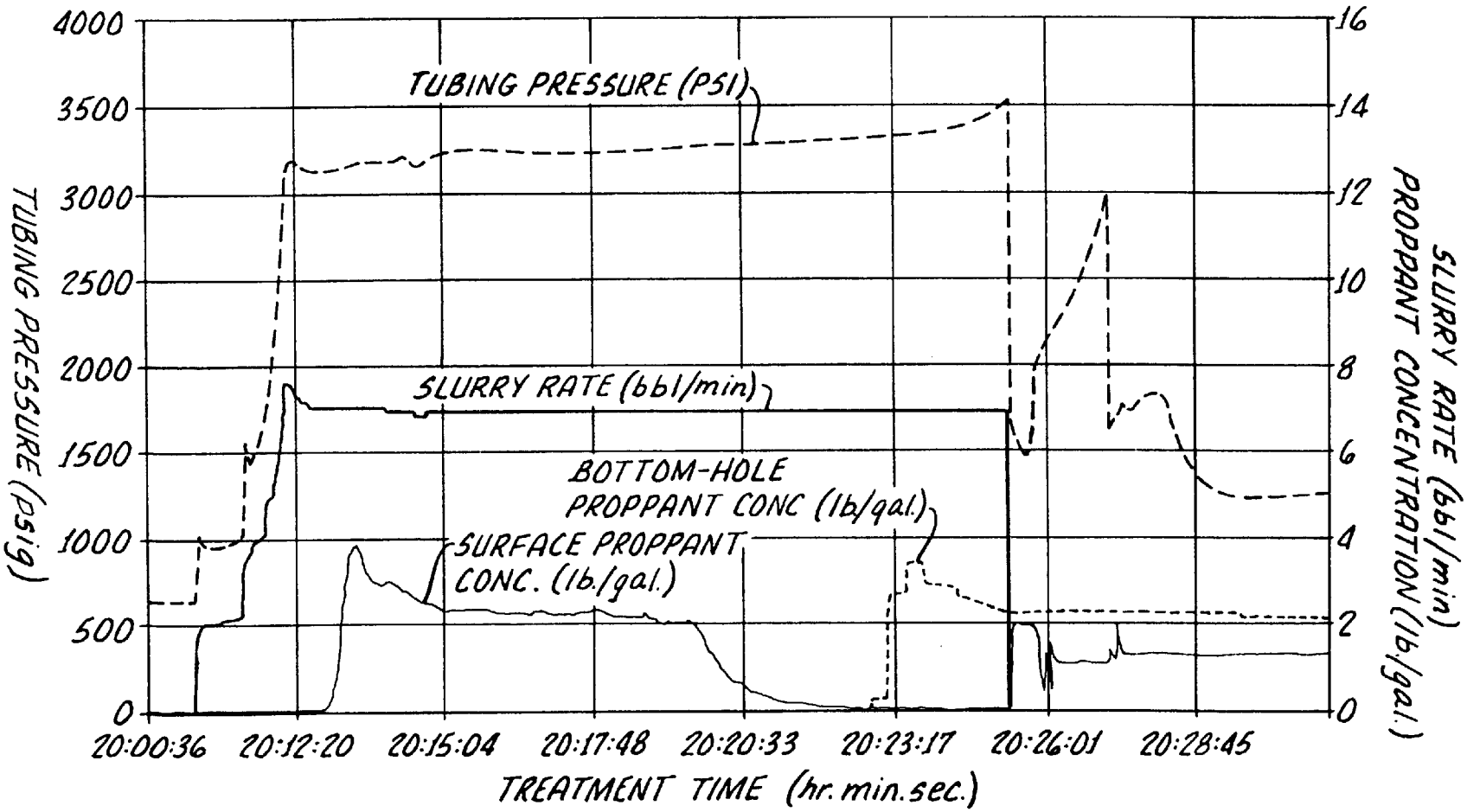
FIG. 5A shows a plot of an actual gravel pack treatment using the inventive apparatus.

(to shear the pump-out plug 14)
where:

dPf is friction pressure, psi
f is friction factor
MD is measured depth, ft
Vel is velocity, ft/sec
RHO is fluid density, lb/cu ft
d is tubing diameter, ft
Pwfi is formation injection pressure, psi
Ps is static or head pressure, psi
BPM is pump rate, barrels per minute
Ji is injectivity index, barrels per day/(Pwfi−Ps)
WHP is surface treating pressure, psi
TVD is perforation vertical depth, ft
PPG is fluid weight, lbs/gal
Pdp is the pump-out plug shear pressure, psi Assuming the tubing 3 is full of sand slurry when screen-out occurs, the following three equations predict the nominal length of blank section 13 needed:

$$Hso = \frac{1.127\,K(5.615\ Ca)Pdp}{1440(cp)(BPM)} \tag{5}$$

$$Dslv = \frac{(Dscn - Hso)(Ca - Ca \times PPA) - LCa}{Ca + (Ct)(PPA) - (Ca)(PPA)} \tag{6}$$

$$\text{Blank length} > Dscn - Dslv - L \tag{7}$$

where:

Hso is blank coverage at screen out, ft
K is gravel pack permeability, Darcy
Ca is annulus capacity (blank/casing) bbl/ft
Pdp is pump-out plug shear pressure, psi
cp is viscosity, centipoise
BPM is pump rate, barrels per minute
Dslv is sliding sleeve depth, ft
Dscn is gravel pack screen depth, ft
PPA is sand concentration, bbl-sand/bbl
Ct is tubing capacity, bbl/ft
L is partial assembly length (from sliding sleeve to top of the blank section), ft FIG. 5A shows a plot of actual data acquired while performing an initial gravel pack treatment in an existing well using the inventive apparatus. An apparatus similar to that illustrated in FIG. 1 was attached to a 2⅞ inch tubing string and run into a cased and perforated wellbore. The well was constructed with 7 inch casing at a 10,317 foot perforation depth.

The plot shown in FIG. 5A shows the gravel pack slurry was displaced at a pump rate of about 6.9 bb/min and an initial surface treating pressure of about 3,230 psig. At about time 20:23:00, the gravel pack began accumulating in the perforations. At about time 20:25:00 the gravel pack had substantially formed and excess sand began to de-entrain in the annulus between the blank tubing and well casing. The de-entrained sand restricts the displacement of fluid to the perforations. This event is identified by a steep increase of surface treating pressure to about 3,553 psig. To avoid higher surface treating pressure, the pump rated was then decreased to about 1.0 bbl/min. As excess sand continued to de-entrain in the annulus, the increased restriction eventually resulted in rupture of the pump-out plug thereby opening a less restricted flow path to the perforations. This event is identified by the sharp decrease of surface treating pressure from about 3,000 psi to about 1,592 psi at about time 20:27:00. The remaining excess slurry was then displaced out of the production tubing. The excess sand was de-entrained on the tell-tale screen and deposited on the gravel pack.

Figure 5B:
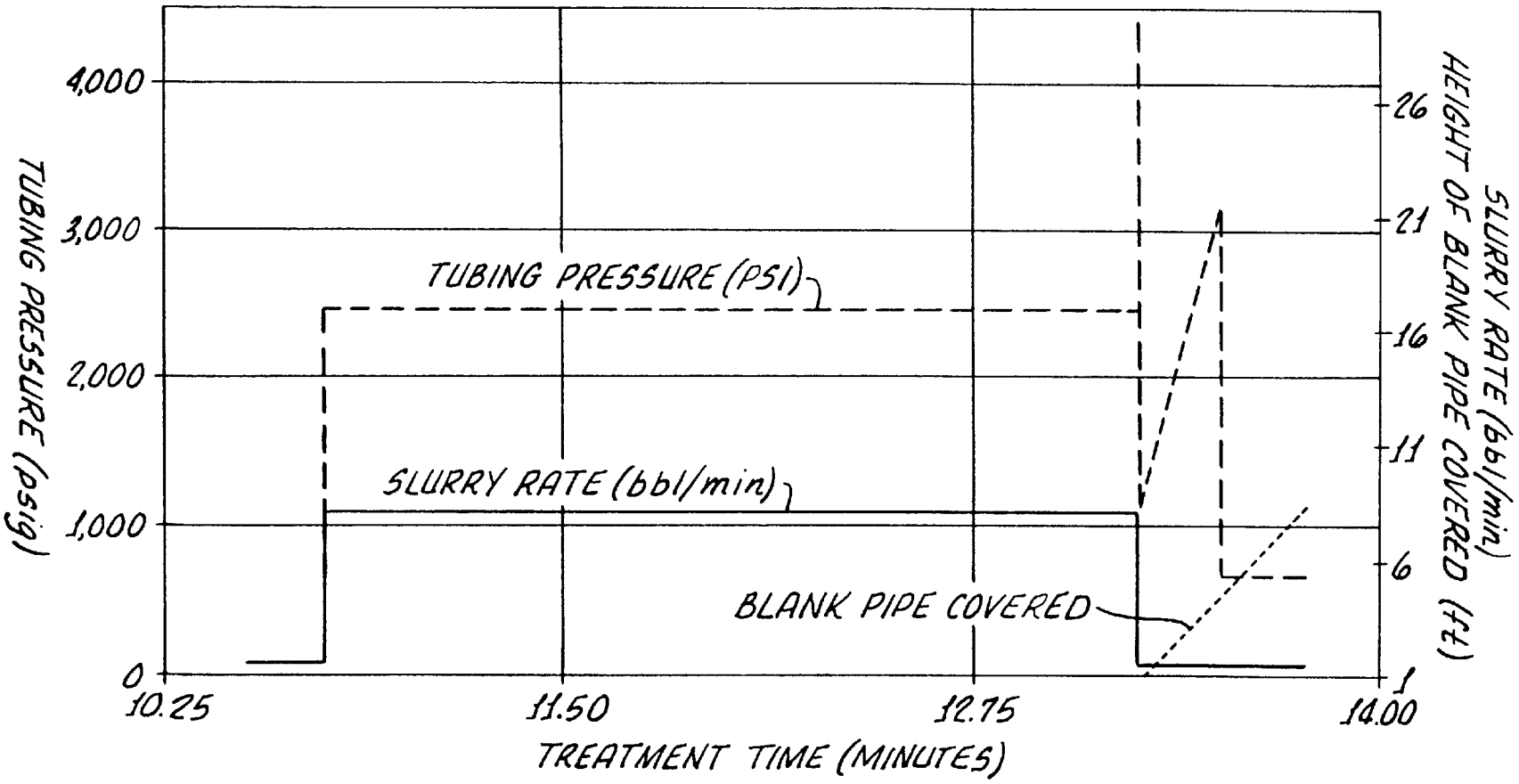
FIGS. 5B and 5C show plots of calculated parameters while using the inventive apparatus.
Figure 5C:
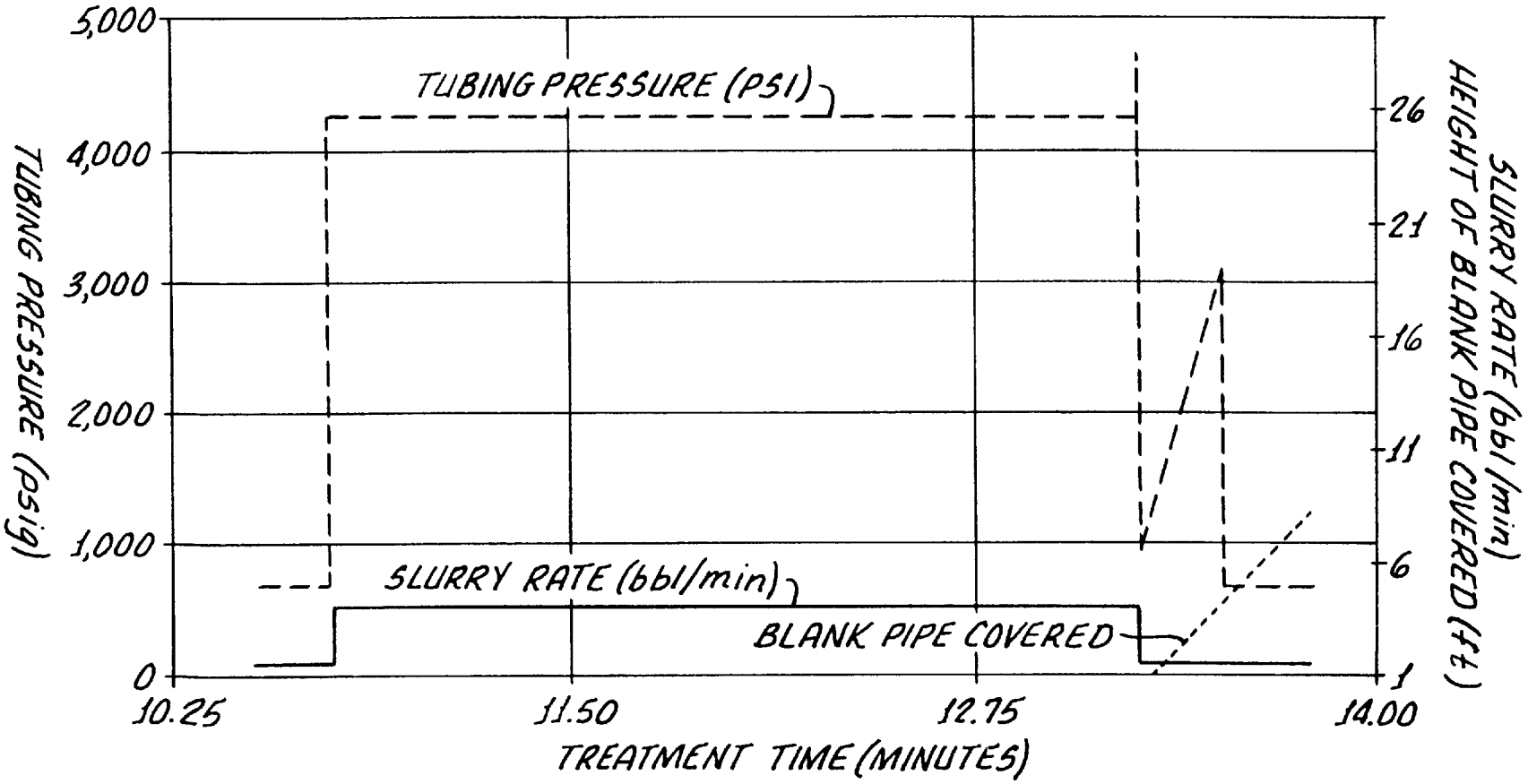

FIGS. 5B and 5C are examples of calculated parameters using the above equations. Both examples are for wells with 2⅞ inch tubing, 0.0151 bbl/ft annular capacity, perforations starting at 5,222 feet deep, 1,360 psi bottom hole (static) pressure, and 8.6 pound per gallon fluid. The plot in FIG. 5B is calculated assuming that the inventive packing process is accomplished with downhole pressures above formation fracture pressure. The plot in FIG. 5C is calculated assuming that the inventive packing process is accomplished with downhole pressures below formation fracture pressure. During both gravel packing process calculations, initial screen-out occurs when the gravel or sand build-up GP reaches a calculated level in the isolated annular space 15 (see FIGS. 1–4) filling the perforations and the isolated annular space near the perforations 6 and gravel pack screen 8. The screen out event is identified by a sharp increase or spike in tubing or injection pressure. In both examples, immediately following screen-out, the pump or slurry rate is decreased to about 0.5 bbl/min and the surface injection pressure increases with time because of the increasing restriction in the diverted flow path caused by the de-entrained particles accumulating in the perforations 6 and isolated annular space 15. As additional particles are deposited in the isolated annular space 15, the differential pressure across the pump-out plug 14 increases until the desired final screen-out pressure is obtained and the pump-out plug 14 is sheared, allowing another, less restricted flow path to the perforations and a reduction in surface pressure.

Although parameters such as the maximum and minimum gravel pack size, sand dimensions, surface injection pressures, sand slurry flow rates, and sand concentration are theoretically unlimited, the inventive process is typically limited to emplacing a gravel pack GP with injection or surface pressures ranging up to about 15,000 psig, entrained sand or gravel sizes ranging from about 8/16 to about 40/60 US mesh, slurry flow rates from about 1 to about 20 bbls/min., and to a sand concentration in the slurry ranging from about 0.5 to about 10 lbs/gal., more preferably within the concentration range from about 1 to about 4 lbs/gal.

Still other alternative embodiments are possible. These include: a plurality of gravel packer assemblies within a wellbore for packing several formations of interest penetrated by the well, a single means for screening instead of two separate screening elements shown in the preferred embodiment, pumping a sand slurry to emplace an initial portion of the gravel pack GP followed by pumping a slurry having a different average mesh size and/or different entraining fluid in the tubing string 3 to complete the desired gravel pack GP, and providing a downhole pump attached to the tubing string 3 to improve formation fluid recovery. The inventive gravel pack apparatus and process can also be applied to injection wells, water wells, solution mining excavations, and geothermal wells.

While the preferred embodiment of the invention has been shown and described, and some alternative embodiments also shown and/or described, changes and modifications may be made thereto without departing from the invention. Accordingly, it is intended to embrace within the invention all such changes, modifications and alternative embodiments as fall within the spirit and scope of the appended claims.

What is claimed is:

1. An apparatus useful for gravel packing a fluid production well, the well having perforations extending into a subsurface productive formation, said apparatus comprising:

a tubing string having a passageway substantially extending from a near-surface location to a subsurface location proximate to said perforations when said tubing string is placed in said well creating a substantially annular space between the exterior of said tubing string and the interior of said well proximate to said tubing string;

a packer attached to said tubing string, said packer restricting axial fluid flow between a lower annular space and an upper annular space;

a radial-flow port in fluid communication with said passageway capable of allowing fluid flow between said lower annular space and said passageway;

a first openable passageway restrictor in fluid communication with said passageway below said radial-flow port;

a first radial-flow means for screening connected to said tubing string and capable of screening particles entrained in a fluid flowing from said lower annular space to said passageway, wherein at least a portion of said first radial-flow means for screening is located below said first openable passageway restrictor substantially above said perforations when said apparatus is installed in said well; and a second radial-flow means for screening connected to said tubing string and capable of screening particles entrained in a fluid flowing between said lower annular space and said passageway, at least a portion of said second radial-flow means for screening located below said first radial-flow means for screening by at least about 2 feet and proximate to said perforations when said apparatus is installed in said well.

2. The apparatus of claim 1 wherein said first and second radial-flow means for screening comprise screen ports with the apparatus for that comprising:

a blank tubing string portion located substantially between said first radial-flow screened port and said second radial-flow screened port;

a second openable passageway restrictor attached to said blank tubing string portion; and means for opening said second openable passageway restrictor prior to opening said first openable passageway restrictor.

3. The apparatus of claim 2 which also comprises:

a sand slurry pump fluidly connected to said tubing string; and fluid handling piping fluidly connected to said tubing string and said sand slurry pump.

4. The apparatus of claim 3 wherein said second openable passageway restrictor comprises a pressure rupturable plug and said means for opening comprises a pump generating a differential pressure across said pressure rupturable plug.

5. An apparatus useful for gravel packing a portion of a subsurface well comprising:

a duct having a passageway substantially extending from a near-surface location to a subsurface location when said duct is placed in said well, said duct creating a substantially annular space between said duct and the inside surface of said well;

an annular restrictor attached to said duct, said annular restrictor capable of restricting axial fluid flow between a lower annular space and an upper annular space;

a radial-flow port attached to said duct capable of allowing fluid flow between said lower annular space and said passageway;

a first passageway restrictor connected to said duct and located below said radial-flow port; and means for screening connected to said duct at a location below said first passageway restrictor, said means for screening capable of separating a portion of particles entrained in a slurry fluid flowing from said lower annular space to said passageway creating a screened slurry flow centered at a first screening location below said first passageway restrictor, and wherein said means for screening is also capable of substantially returning said screened slurry fluid flow from said passageway to said lower annular space centered at a second location at least about 2 feet from said first screening location.

6. The apparatus of claim 5 wherein said means for screening comprises a first screened port attached to said duct and a second screened port attached to said duct and located below said first screened port.

7. The apparatus of claim 6 which also comprises:

a blank duct portion located substantially between said first screened port and said second screened port; and a second passageway restrictor attached to said blank duct portion.

8. The apparatus of claim 6 which also comprises a pump capable of pumping a sand slurry within said duct from said near-surface location to said subsurface location.

9. The apparatus of claim 6 wherein a length of blank duct portion is located substantially between said first screened port and said second screened port and said blank duct portion is at least about 10 feet.

10. The apparatus of claim 6 wherein a length of blank duct portion is located substantially between said first screened port and said second screened port and said blank duct portion is at least about 30 feet long.

11. The apparatus of claim 6 wherein a blank duct potion is located substantially between said first screened port and said second screened port and the diameter of said blank duct portion is within the range of about 20 to about 80 percent of the diameter of said inside surface of said well.

12. The apparatus of claim 6 wherein a blank duct potion is located substantially between said first screened port and said second screened port and the diameter of said blank duct portion is within the range of about 40 to about 60 percent of the diameter of said inside surface of said well.

13. The apparatus of claim 6 wherein:

said duct comprises a tubing string;

said annular restrictor comprises a hydraulic-set packer; and said radial-flow port in said duct comprises a sliding sleeve.

14. The apparatus of claim 6 wherein:

said first passageway restrictor comprises a removable disk; and which also comprises a second passageway restrictor comprising a pressure rupturable plug.

15. The apparatus of claim 5 which also comprises:

a subsurface safety control valve attached to said duct and located above said radial-flow port; and a landing nipple attached to said duct and located below said subsurface safety control valve.

16. An apparatus useful for gravel packing a portion of a subsurface well comprising:

a duct having a passageway substantially extending from a near-surface location to a subsurface location when said duct is placed in said well, said duct creating a substantially annular space between said duct and an inside surface of said well;

an annular restrictor attached to said duct, said annular restrictor capable of restricting axial fluid flow between a lower annular space and an upper annular space;

means for allowing fluid flow between said lower annular space and said passageway;

a passageway restrictor connected to said duct and located below said means for allowing fluid flow between said lower space and said passageway; and means for screening a portion of particles entrained in a slurry fluid flowing from said lower annular space to said passageway at a first location and returning a screened slurry fluid flow from said passageway to said lower annular space, wherein said duct has an outside diameter of greater than about 3½ inches and is capable of handling pressures of no greater than about 20,000 psi.

17. The apparatus of claim 16 wherein said duct is not connected to a means for backflushing.

18. The apparatus of claim 17 wherein said duct is not attached to a well intervention unit.

19. A process for completing a well, the well having a tubing string enclosing a tubing passageway substantially extending from a near-surface location to near a fluid-producing zone in a subsurface formation and forming an annulus between said production tubing string and portions of said well, said process comprising the steps of:

(a) placing a gravel packing assembly in said well attached to said tubing string;

(b) pumping a slurry down said tubing string wherein said slurry is diverted through a first opening into said annulus by a first passageway plug and wherein said slurry in said annulus is in fluid communications through a screened port with a second interior passageway plug located below said first interior passageway plug;

(c) opening said second interior passageway plug; and (d) opening said first interior passageway plug after opening said second interior passageway plug.

20. The process of claim 19 wherein said gravel packing assembly also comprises a screened opening located below said second interior passageway plug, and which process also comprises the steps of:

(e) pumping a displacement fluid down said tubing string prior to the step of opening said second interior passageway plug; and (f) flowing fluids from said fluid-producing zone through said tubing after the step of opening said first interior passageway plug.

21. The process of claim 20 which also comprises the step of (g) restricting fluid flow through said first opening after the step of opening said second interior passageway plug.

22. The process of claim 21 wherein said step of pumping a displacement fluid occurs after said step of opening said first interior passageway plug.

23. The process of claim 22 wherein said step of opening said second interior passageway plug comprises the rupturing of said second interior passageway plug, wherein said rupturing results from fluid flow across a build-up of de-entrained particles in said annulus when the axial length of said build-up reaches a plug rupturing length.

24. The process of claim 23 which also comprises the step of calculating said plug rupturing length.

25. The process of claim 24 wherein said gravel packing assembly also comprises a blank tubing portion of production tubing string located between portions of said screened opening and wherein said process also comprises the step of restricting said first opening.

26. A process for completing a well, the well having a duct assembly extending from a near-surface location to near a fluid-producing zone in a subsurface formation, said duct assembly having an interior passageway and forming an annular space between said duct assembly and said well, said process comprising the steps of:

(a) placing said duct assembly in said well;

(b) pumping a slurry down said duct assembly wherein said slurry comprises a slurry fluid and entrained particles, wherein said slurry is diverted from said interior passageway into said annular space through an opening by a first passageway restriction located below said opening and a portion of said particles de-entrain in said annular space to form a gravel pack proximate to said fluid-producing zone;

(c) substantially removing said first passageway restriction in the absence of a well intervention unit after said gravel pack extends substantially above said fluid-producing zone and prior to producing fluids from said fluid-producing zone; and (d) producing fluids from said fluid-producing zone through said gravel pack.

27. A process for gravel packing a wellbore, the wellbore having a substantially axial-flow duct passageway extending from a near-surface location to near a fluid-producing zone in a subsurface formation, said duct passageway forming an annular space between said duct passageway and said wellbore, said process comprising the steps of:

(a) placing a packing assembly attached to said duct passageway in said wellbore using a well intervention unit wherein said packing assembly comprises a plurality of screened opening portions allowing fluid communication between said duct passageway and said annular space;

(b) pumping a slurry containing particles down said duct passageway wherein said slurry is diverted into said annular space through means for diverting fluid and a portion of said particles de-entrain in said annular space to form a gravel pack proximate to said fluid-producing zone and a lower screened opening portion while another screened opening portion is above and spaced apart from said lower screened opening portion by at least about 2 feet and wherein said duct passageway allows substantial fluid flow between said spaced apart screened opening portions at the conclusion of said pumping step; and (c) producing fluids from said fluid-producing zone through at least a portion of said gravel pack and at least one of said screened opening portions.

28. The process of claim 27 wherein said pumping step comprises pumping a slurry having a first concentration of particles followed by pumping a slurry having a decreased concentration of particles.

29. The process of claim 27 wherein said pumping step comprises pumping a slurry having particles with a first average mesh size followed by pumping a slurry having particles with a significantly different average mesh size.

30. The process of claim 27 wherein said process steps are accomplished in the absence of a significant reverse flow of slurry within said duct passageway.

31. The process of claim 27 wherein said process steps are accomplished in the absence of a flushing step using a separately conducted fluid.

32. A process for gravel packing a wellbore, the wellbore having a substantially axial-flow duct passageway extending from a near-surface location to near a fluid-producing zone in a subsurface formation, said duct passageway forming an annular space between said duct passageway and said wellbore, said process comprising the steps of:

(a) placing a packing assembly attached to said duct passageway in said wellbore using a well intervention unit wherein said packing assembly comprises a plurality of screened opening portions allowing fluid communication between said duct passageway and said annular space;

(b) pumping a slurry containing particles down said duct passageway wherein said slurry is diverted into said annular space through a means for diverting fluid and a portion of said particles de-entrain in said annular space to form a gravel pack proximate to said fluid-producing zone and a portion of said screened opening while another portion of said screened opening is spaced apart from said gravel pack; and (c) producing fluids from said fluid-producing zone through said gravel pack and said screened opening wherein said pumping step comprises generating a pressure-differential substantially across the axial length of said gravel pack followed by generating a radial pressure-differential substantially across a radial dimension of said gravel pack.

33. A process for placing a gravel pack in a well, the well having a duct extending from a near-surface location to near a fluid-producing zone in a subsurface formation, said duct having an interior passageway and forming an annular space between said duct and said well, said process comprising the steps of:

placing a packing assembly attached to said duct in said well, said assembly having a substantially axial-flow path connected to said interior passageway, a substantially radial-flow path connecting said axial-flow path to said annular space, a first screened flow path from said annular space to said axial flow path allowing pre-screened slurry flow into said axial flow path, and a second screened flow path from said axial flow path to said annular space; and pumping a pre-screened slurry substantially through said first screened flow path.

34. The process of claim 33 wherein said pumping step is followed by pumping a displacement fluid through said first screened path.

35. The process of claim 34 wherein a portion of the step of pumping of a displacement fluid occurs in the absence of a substantial flow of said displacement fluid through said radial-flow path.

* * * * *